United States Patent [19]

Brehmer

[11] 3,971,392

[45] July 27, 1976

[54] HAIRPIECE, PARTICULARLY A TOUPET, AND PROCESS FOR MAKING SAME

[75] Inventor: Kurt A. Brehmer, Bremen, Germany

[73] Assignee: Firma Carl Brehmer & Sohn, Bremen, Germany

[22] Filed: Apr. 12, 1974

[21] Appl. No.: 460,306

[30] Foreign Application Priority Data

Oct. 20, 1973 Germany ..... 2352818

[52] U.S. Cl. ..... 132/53; 132/5

[51] Int. Cl.[2] ..... A41G 3/00

[58] Field of Search ..... 132/53, 54, 5, 7, 9; 28/74; 41/10

[56] References Cited

UNITED STATES PATENTS

| | | | |
|---|---|---|---|
| 1,464,089 | 8/1923 | Ernest | 132/53 |
| 1,490,466 | 4/1924 | Hupka | 132/53 |
| 2,567,119 | 9/1951 | Naidor | 41/10 |
| 3,037,261 | 6/1962 | Hess | 28/74 |
| 3,162,203 | 12/1964 | Cramer | 132/5 |
| 3,420,249 | 1/1969 | Bonham | 132/53 |
| 3,470,889 | 10/1969 | Webb | 132/53 |
| 3,589,376 | 6/1971 | Kohler | 132/53 |

*Primary Examiner*—G.E. McNeill

*Attorney, Agent, or Firm*—Olson, Trexler, Wolters, Bushnell & Fosse, Ltd.

[57] ABSTRACT

The hairpiece consists of a foundation made from a single thickness of plastic sheets and hairs which are inserted through hair channels in the foundation. The hairs are secured in place in the foundation by plugs of adhesive inserted in the hair channels.

The hairpiece is made by placing a sheet of plastics material on a mould corresponding in shape to the head of the eventual user, inserting hairs through the hair channels in that foundation, the ends of the hairs projecting beyond the internal surface of the foundation, removing those parts of the hairs that project from the internal surface, applying to the internal surface an adhesive which has a viscosity and a capillary adhesion such that the adhesive penetrates and fills the hair channels, and finally, after the adhesive has set, removing the adhesive from the internal surface of the foundation, while leaving the adhesive in place in the hair channels as plugs.

5 Claims, 4 Drawing Figures

HAIRPIECE, PARTICULARLY A TOUPET, AND PROCESS FOR MAKING SAME

This invention relates to a hairpiece, and particularly a toupet, comprising a foundation which is curved in accordance with the shape of the head, or a part of a head, and of hairs which are inserted in the foundation and the ends of which penetrate hair channels in the foundation and are attached thereto by an adhesive. The invention is also concerned with a process for making a hairpiece of that type.

There have been numerous proposals in the past for the making of hairpieces of the type described. In U.S. Pat. No. 1,464,089, for example, the foundation is formed on a mould which simulates the head of the eventual wearer, and is made of a layer of silk fibres having a gelatine and glycerine coating. The hairs are inserted into the foundation in such a way that they project slightly beyond its interior surface. The hairs are then held in place by an adhesive covering consisting of rubber and collodium mixture applied to the interior surface of the foundation and including the projecting ends of the hairs. The hairpieces of the U.S. patent are difficult to manufacture and, what is more important, are not entirely satisfactory in use.

Recently, a hairpiece structure has been widely adopted having a foundation of plastics material, particularly polyvinylchloride polymer, which has the advantage that relatively thin films of the plastics material can be obtained. The foundation is formed from a layer of the monomer liquid in which the hairs, appropriately held and exposed, are inserted; this method is expensive to operate, entailing charging the hairs electrostatically with the same sign, so that they repel one another and are held spaced while the plastics material solidifies, or knotting the ends of the hairs to a supporting and reinforcing fabric (U.S. Pat. No. 3,189,035), or temporary securing the hairs in auxiliary moulds on which the film has been formed and through which the full length of each hair has to be drawn (German Pat. No. 1,710,469).

Whenever synthetic resin sheet has been used as the foundation, a number of layers of the sheet have had to be secured together to form a laminate, or a single sheet has had to be coated similarly to form a laminate, and the ends of the hairs are embedded in the laminate so as to lie substantially in the plane of the laminate (German Pat. No. 1,952,181). The embedded ends of the hairs, however, not only detract from the appearance of the final hairpiece but also cause all hairs to emerge from the foundation at an acute angle, so that they do not simulate natural hair which grows more or less perpendicular to the surface of the head. It is therefore almost impossible to lay the hairs in any direction other than that in which they are placed on insertion in the foundation. In particular, the hairpiece fails to simulate natural hair, since the hairs fail to take firstly an upward direction and then to descend onto the head.

An object of the invention is to provide a hairpiece having hair emerging from the foundation in a natural manner, while being able to withstand considerable wear and to be able to be manufactured without excessive cost.

Broadly, the invention resides in a hairpiece comprising a foundation formed as a plastics sheet which is curved to the shape of the head or a part thereof, and hairs the ends of which are inserted in, and penetrate through, hair channels in the foundation, the hairs in each such channel being secured to the foundation by a plug of adhesive. In this way, it is possible to dispense with a laminar foundation and to avoid the before-mentioned undesirable presetting of the hairs in given directions in relation to the outer surface of the foundation. The finished, single layer, foundation may be provided with perforations, additional to the hair channels, for the circulation of air through the foundation and regulation or moisture.

The foundation preferably consists of translucent matt polyvinylchloride polymer, while the adhesive plug is preferably made of a cyanacrylate adhesive composition. An adhesive having a cyanacrylate base has proved particularly advantageous, owing to its limited viscosity in its initial state, its rapid setting and its high binding power, particularly to other plastics materials.

For a fuller understanding of the invention, reference should be made to the following detailed description, taken in conjunction with the accompanying drawing, in which.

Figure 1:
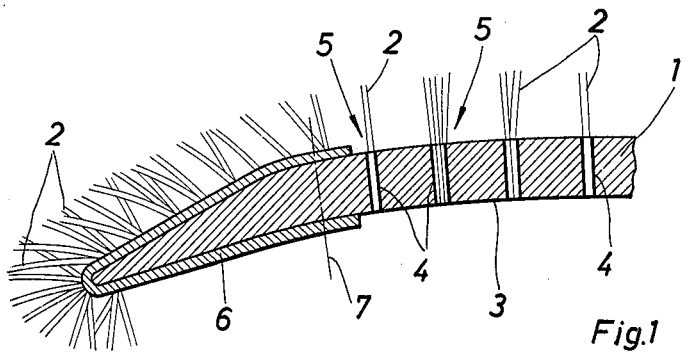
FIG. 1 is a section of part of the edge zone of a toupet according to the invention.

The toupet shown in FIG. 1 consists of a PVC foundation 1 having a thickness of about 0.5 to 2 mm. Hairs 2 are inserted through hair channels extending perpendicularly to the plane of the foundation. The inserted ends of the hairs 2 lie level with the interior surface 3 of the foundation. Individual plugs 4, of synthetic resin adhesive, located in the hair channels securely lock each hair or bundle of hairs in its channel.

The edge of the foundation 1 is bevelled as shown in FIG. 1 and is bound with a polyamide fiber tape 6 having a woven surface to which hairs 2 are attached. Tape 6 is secured by stitching or similar process to the foundation 1 as indicated by the chain line 7.

Figure 2:
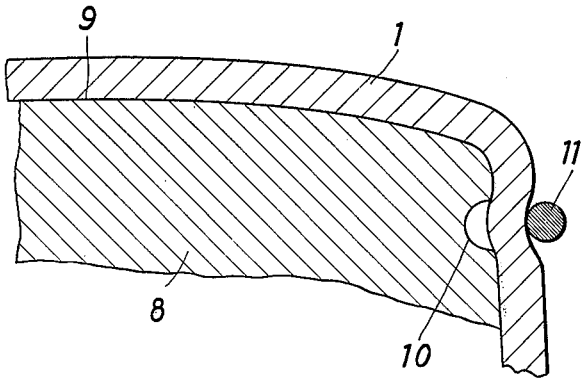
FIG. 2 is a section through the foundation of plastics material and a mould during the making of the foundation.

The toupet illustrated in FIG. 1 is made as follows:

A male mould 8 is produced in conventional manner to accord with the shape of the head for which the toupet is intended. The surface 9 of the mould is however somewhat larger than the required toupet. A notch 10 is then cut into the side of the mould 8 and extends the whole way round the mould. A translucent and preferably flesh-coloured sheet of the PVC foundation sheet 1, having the desired thickness and adequate size, is stretched over the mould 8 in the manner shown in FIG. 2 and secured in that position by means of a wire or rubber ring 11 which is received in the notch 10. The foundation 1 is heated for one hour at a suitable temperature, e.g. 180°C for PVC, to relieve stresses within the foundation 1, so that the foundation accurately fits the curvature of the surface of mould 8. The heat treatment has the added advantage that a dull, matt, finish is given to the initially shiny PVC sheet.

The foundation 1 is allowed to cool and is then removed, cut to the required size and bevelled at its edges. The bevelled edges are bound with the tape 6 as shown in FIG. 1 and hairs 2 are attached to the tape, being arranged, for example, in three rows on the underside and about five rows on the upper side; the hairs in each row being staggered with respect to those in adjacent rows.

Figure 3:
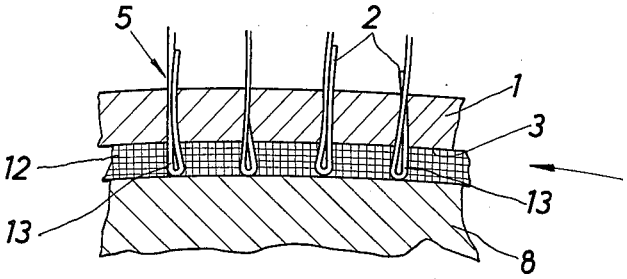
FIG. 3 shows in section a part of the mould with a protective layer and the foundation placed on it, and after the insertion of hairs.

The mould 8 is covered with a protective layer in the form of a film 12 (FIG. 3) in order to ensure that when the hairs 2 are subsequently inserted through the foundation 1, the inserting needle used for that purpose will not be damaged by the hard surface of the mould; the film 12 is preferably made of PVC with a thickness of 0.4 mm and may be formed with a raster of printed dots or the like. The foundation 1 with the binding tape 6 is then nailed onto the mould 8 above the protective film 12. Hairs 2 are then inserted in known manner as shown in FIG. 3, so that the ends extend below the interior surface of the foundation 1 and penetrate the protective film 12. Normally 60 to 100 hair passages 5 to the square centimeter are made, with one or two hairs, for light toupets, or three hairs, for full toupets, inserted in each of the hair passages. The hairs are inserted in tufts; while the hairs are generally inserted into the foundation 1 by hand, it may be performed by a suitable machine, in which case five needles, for example, are inserted in a row into the foundation 1. Machine insertion is preferred when natural hairs with short tufts are being inserted.

After the insertion of the hairs, the foundation 1 is removed together with the hairs 2 which are temporarily held in the foundation by the elasticity of the foundation material; those parts of the hairs previously lying within the protective film 12 now project freely from the interior surface of the foundation 1. Those parts 13 are roughly cut off with a hair cutting machine, after which the interior surface 3 of the foundation 1 is shaved clean.

Figure 4:
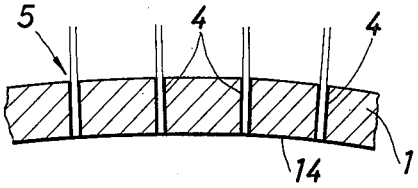
FIG. 4 is a section through part of the completed toupet.

An adhesive, which is preferably a relatively nonviscous, rapid-settng cyanacrylate adhesive, such as that marketed by the firm of ISAR-RAKOLL CHEMIE GMBH under the name "ISAMET A", is applied to the interior surface 3 of the foundation 1. The adhesive is selected to have a viscosity and a capillary adhesive property such that the adhesive penetrates the capillary passages formed within the hair channels 5 during the insertion of the hairs 2. After the adhesive has set, the penetrated adhesive forms plugs 4 (FIGS. 1 and 4) in the individual hair channels 5, the plugs being connected to one another on the interior surface 3 of the foundation 1 by more or less continuous layer 14 of adhesive.

Finally the layer 14 is removed, for example by rubbing with wet gringing paper, the individual plugs 4 remaining within the hair channels 5 and securely anchoring the inserted hairs in the foundation 1. The toupet, which is now largely completed, is finished in the usual manner.

It will be appreciated that, if the wearer's natural hairs become grey, the hairs 2 of the toupet can be readily supplemented or replaced by grey or white hairs where necessary in the foundation 1. Further it should be emphasised that the edge binding 6 is not always necessary and can be dispensed with, if desired.

The invention is claimed as follows:

1. A hairpiece comprising a. a foundation formed as a plastic sheet which is curved to the shape of the head or a part thereof and having a plurality of holes therein perpendicular to the surface of said sheet and each of a diameter large enough to receive a plurality of hairs therein, b. a plurality of hairs perpendicular to the surface of said sheet, the ends of which are inserted in said holes in said plastic sheet from one side thereof, and terminating flush at the other side thereof, there being at least one hair in each of said holes, and c. a plug of adhesive in each such hole securing said hairs to said plastic sheet, each such plug terminating flush with the inner surface of said sheet.

2. A hairpiece according to claim 1, wherein said foundation is made of translucent polyvinylchloride polymer having a dull finish.

3. A hairpiece according to claim 1, wherein said adhesive is a cyanacrylate adhesive.

4. A method of making hairpiece comprising the steps of a. forming a foundation from plastics sheet, said foundation being curved to the shape of the head or a part thereof and being provided with a plurality of hair channels therein, each of large enough diameter to receive a plurality of hairs, b. placing said foundation on a mould corresponding to said shape, c. inserting hairs through said hair channels in said foundation, the ends of said hairs projecting beyond the internal surface of said foundation, d. removing the parts of said hairs projecting from said internal surface flush with said internal surface, e. applying to said internal surface an adhesive having a viscosity and capillary adhesion such that said adhesive penetrates and fills said hair channels, without appreciably moistening the hairs on the exterior of said foundation, and f. after said adhesive has set, removing said adhesive from the internal surface of said foundation.

5. A method of making a hairpiece according to claim 4, wherein a protective layer is inserted between said mould and said foundation prior to insertion of said hairs.

* * * * *